US005254064A

United States Patent [19]

Rock

[11] Patent Number: 5,254,064

[45] Date of Patent: Oct. 19, 1993

[54] RESILIENT ARM EXERCISING DEVICE FOR ATTACHMENT TO A STATIONARY SUPPORT SUCH AS A TREADMILL

[76] Inventor: Donna J. Rock, P.O. Box 834, Riverton, Utah 84065

[21] Appl. No.: 905,441

[22] Filed: Jun. 29, 1992

[51] Int. Cl.[5] ..... A63B 21/02

[52] U.S. Cl. ..... 482/126; 482/123; 482/129; 482/54

[58] Field of Search ..... 482/126, 123, 129, 131, 482/54, 51

[56] References Cited

U.S. PATENT DOCUMENTS

| | | | |
|---|---|---|---|
| 605,237 | 6/1898 | Spink | 482/129 |
| 704,840 | 7/1902 | Korth et al. | 482/129 |
| 4,109,905 | 8/1978 | Meier | 482/55 |
| 4,477,073 | 10/1984 | Koch et al. | 482/129 X |
| 4,733,862 | 3/1988 | Miller | 482/126 |
| 4,779,867 | 10/1988 | Hinds | 482/126 |
| 4,948,117 | 8/1990 | Burke | 482/129 X |

FOREIGN PATENT DOCUMENTS

| | | | |
|---|---|---|---|
| 0028659 | of 1910 | United Kingdom | 482/126 |

*Primary Examiner*—Robert Bahr
*Assistant Examiner*—Lynne A. Reichard
*Attorney, Agent, or Firm*—Leon Gilden

[57] ABSTRACT

An apparatus is arranged for arm manipulation simultaneously with treadmill use, to include a mounting strap securable about upstanding posts of a treadmill structure, with an anchor boss mounted medially of the mounting strap having a plurality of exercise straps extending therefrom, with each exercise strap including a loop member for manual grasping. A modification of the invention includes a slide member structure to limit relative pivotment of one exercise strap relative to the adjacent exercise strap.

3 Claims, 4 Drawing Sheets

RESILIENT ARM EXERCISING DEVICE FOR ATTACHMENT TO A STATIONARY SUPPORT SUCH AS A TREADMILL

BACKGROUND OF THE INVENTION

1. Field of the Invention

The field of invention relates to exercise apparatus, and more particularly pertains to a new and improved treadmill exercise apparatus wherein the same is arranged for securement relative to a treadmill structure.

2. Description of the Prior Art

Treadmill structure of various types have been utilized in the prior art to afford exercise to an individual, wherein typically such structure is limited to the user's exercise of legs. Such apparatus is exemplified in U.S. Pat. Nos. 4,974,831; 3,650,529; and 4,869,493.

Accordingly, it may be appreciated that there continues to be a need for a new and improved treadmill exercise apparatus as set forth by the instant invention which addresses both the problems of ease of use as well as effectiveness in construction in providing simultaneous arm and leg manipulation during treadmill use and in this respect, the present invention substantially fulfills this need.

SUMMARY OF THE INVENTION

In view of the foregoing disadvantages inherent in the known types of treadmill exercise apparatus now present in the prior art, the present invention provides a treadmill exercise apparatus wherein the same is addressed to arm and leg manipulation during treadmill use. As such, the general purpose of the present invention, which will be described subsequently in greater detail, is to provide a new and improved treadmill exercise apparatus which has all the advantages of the prior art treadmill exercise apparatus and none of the disadvantages.

To attain this, the present invention provides an apparatus arranged for arm manipulation simultaneously with treadmill use, to include a mounting strap securable about upstanding posts of a treadmill structure, with an anchor boss mounted medially of the mounting strap having a plurality of exercise straps extending therefrom with each exercise strap including a loop member for manual grasping. A modification of the invention includes a slide member structure to limit relative pivotment of one exercise strap relative to the adjacent exercise strap.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved treadmill exercise apparatus which has all the advantages of the prior art treadmill exercise apparatus and none of the disadvantages.

It is another object of the present invention to provide a new and improved treadmill exercise apparatus which may be easily and efficiently manufactured and marketed.

It is a further object of the present invention to provide a new and improved treadmill exercise apparatus which is of a durable and reliable construction.

An even further object of the present invention is to provide a new and improved treadmill exercise apparatus which is susceptible of a low cost of manufacture with regard to both materials and labor, and which accordingly is then susceptible of low prices of sale to the consuming public, thereby making such treadmill exercise apparatus economically available to the buying public.

Still yet another object of the present invention is to provide a new and improved treadmill exercise apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
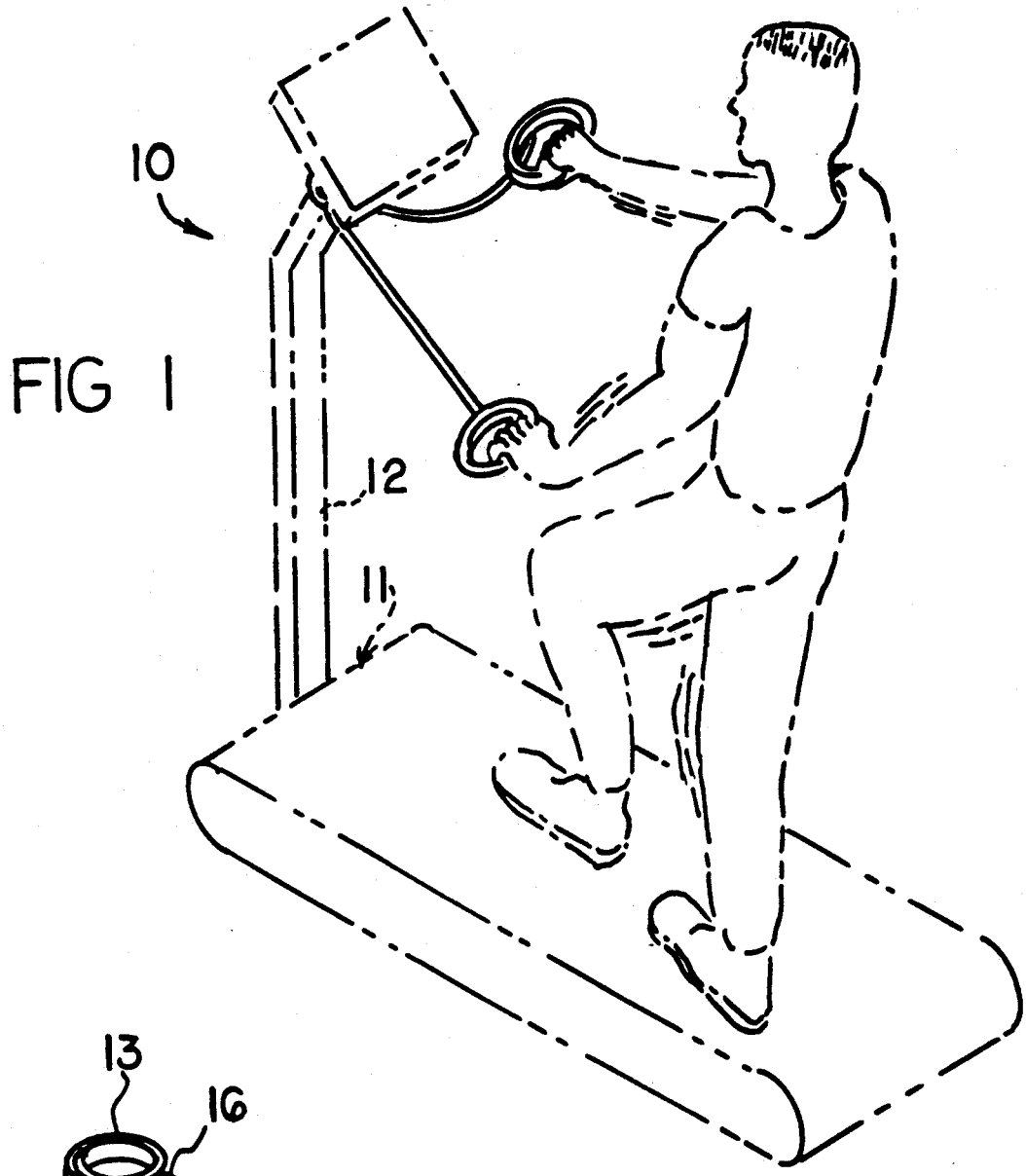
FIG. 1 is an isometric illustration of the instant invention.
Figure 2:
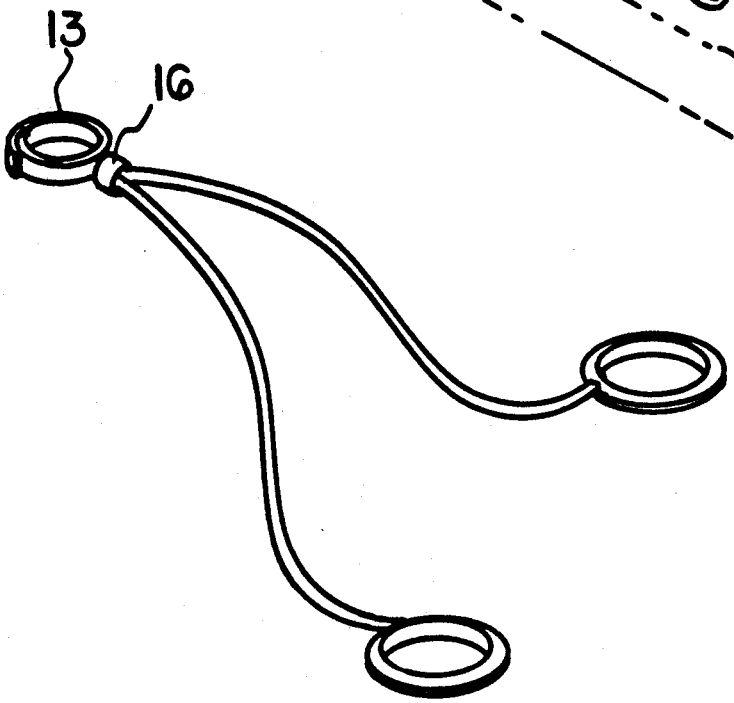
FIG. 2 is an isometric illustration of the invention separated from the associated treadmill device.
Figure 3:
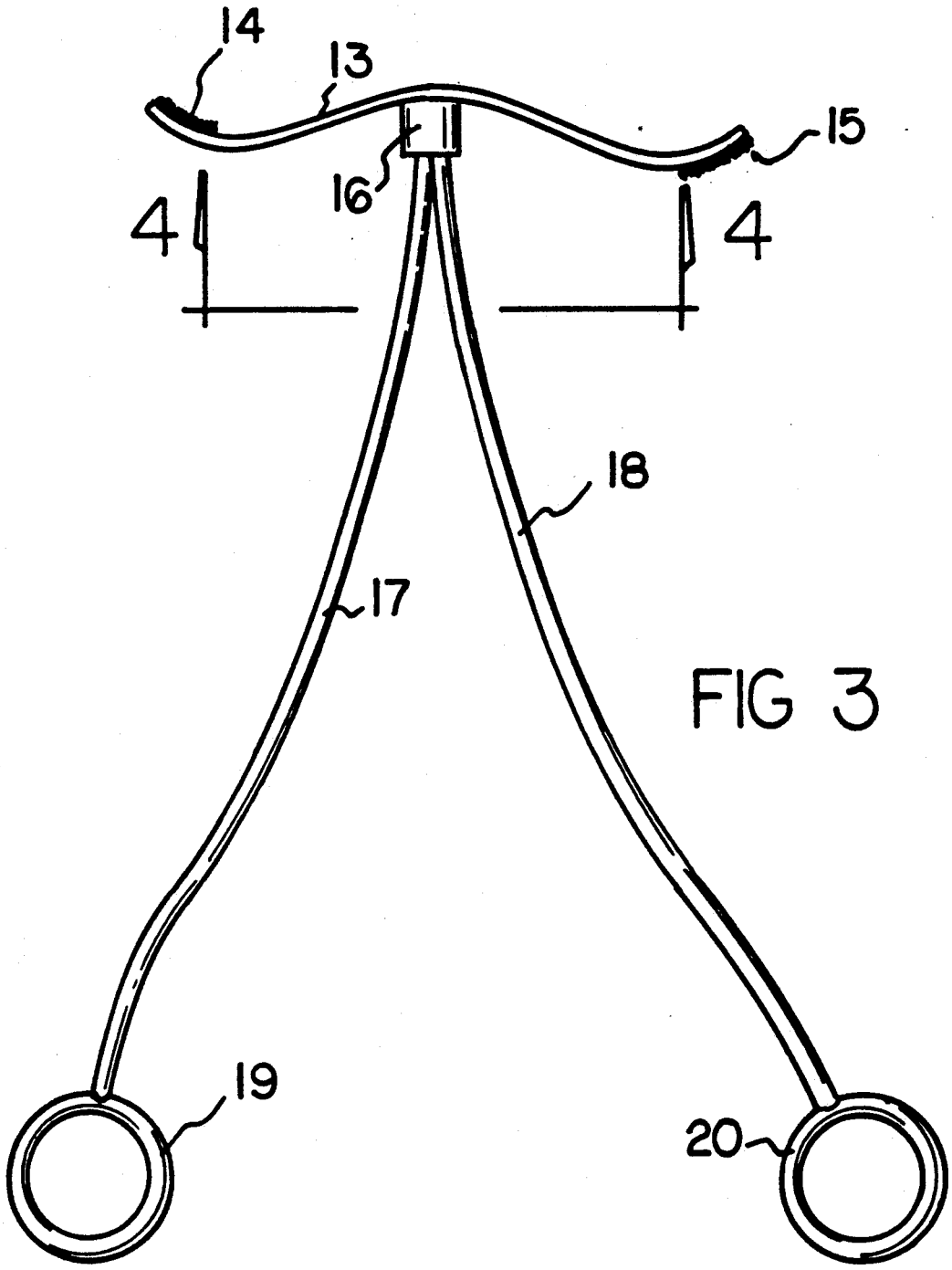
FIG. 3 is an orthographic top view of the invention.
Figure 4:
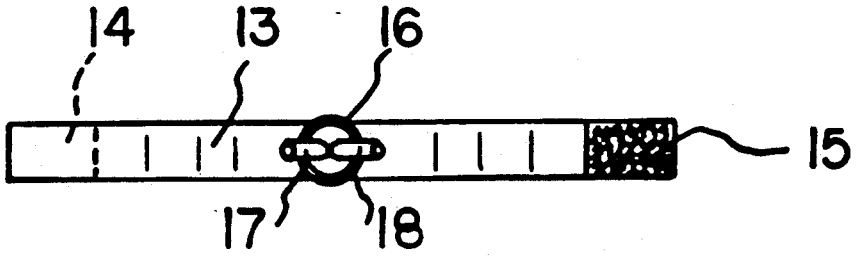
FIG. 4 is an orthographic view, taken along the lines 4—4 of FIG. 3 in the direction indicated by the arrows.

With reference now to the drawings, and in particular to FIGS. 1 to 9 thereof, a new and improved treadmill exercise apparatus embodying the principles and concepts of the present invention and generally designated by the reference numeral 10 will be described.

More specifically, the treadmill exercise apparatus 10 of the instant invention essentially comprises a treadmill member 11 having a treadmill support 12 extending upwardly of an endless conveyor treadmill structure, of a type as indicated in U.S. Pat. No. 4,974,831 incorporated herein by reference.

A mounting collar strap 13 is provided having a strap first end and a strap second end to include respective strap first and second hook and loop fasteners 14 and 15 mounted at the strap's first and second ends to permit securement of the strap about the support 12. An anchor boss 16 is fixedly and medially mounted relative to the collar strap 13 securing elongate first and second flexible straps 17 and 18 at a first end of each of the exercise straps to the boss 16. The exercise straps 17 and 18 are of equal predetermined length having second ends mounting respective first and second strap rings 19 and 20 to the second ends of the first and second exercise straps 17 and 18. In this manner, manual manipulation of the exercise straps 17 and 18 is availed to an individual utilizing the treadmill structure to permit simultaneous arm and leg exercising of that individual during use of the treadmill.

Figure 5:
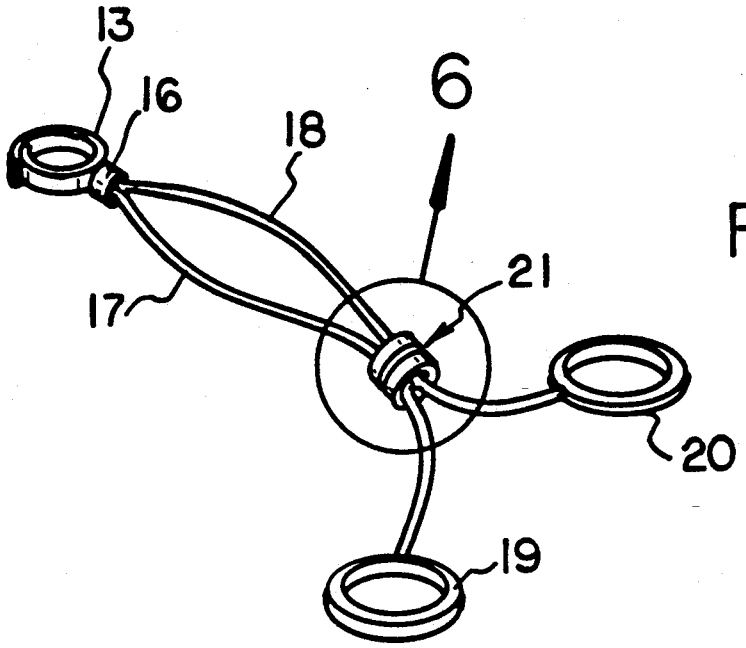
FIG. 5 is an isometric illustration of the invention utilizing a slide member.
Figure 6:
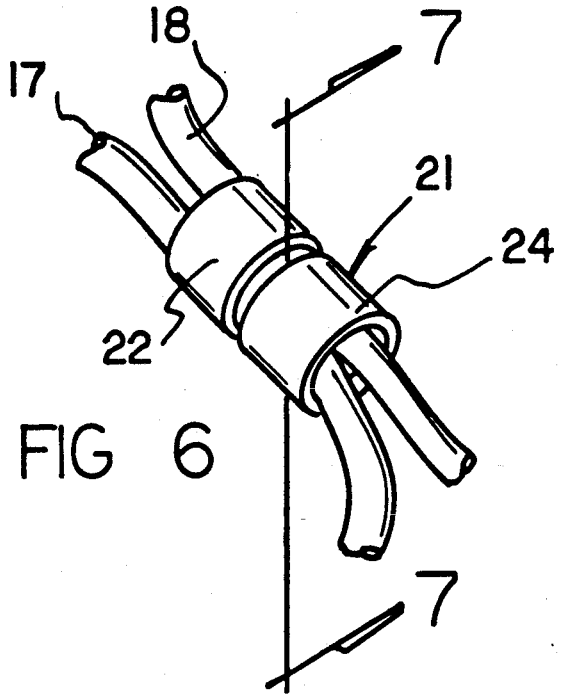
FIG. 6 is an isometric illustration of section 6 as set forth in FIG. 5.
Figure 7:
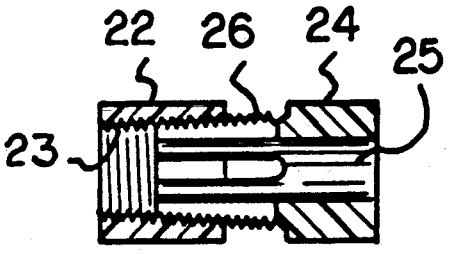
FIG. 7 is an orthographic view, taken along the lines 7—7 of FIG. 6 in the direction indicated by the arrows.

The FIGS. 5–7 illustrate the first and second straps 17 and 18 adjustably received through a slide member 21. The slide member 21 includes a first tube 22 having an internally threaded conical first tube bore 23 coaxially aligned with a second tube bore 25 with the second tube 24. The second tube 24 includes a conically externally threaded axially split plug 26 threadedly received within the first tube bore 23, and the projection of the split plug 26 into the first tube bore 23 effects contracting of the split plug to clamp the first and second straps 17 and 18 therewithin to effect positioning of the slide member as desired along the exercise straps. In this manner, relative constrictive movement of the exercise straps from the slide member 21 to the strap rings 19 and 20 is adjusted altering ease of manipulation of the straps and degree of difficulty in an exercise procedure.

Figure 8:
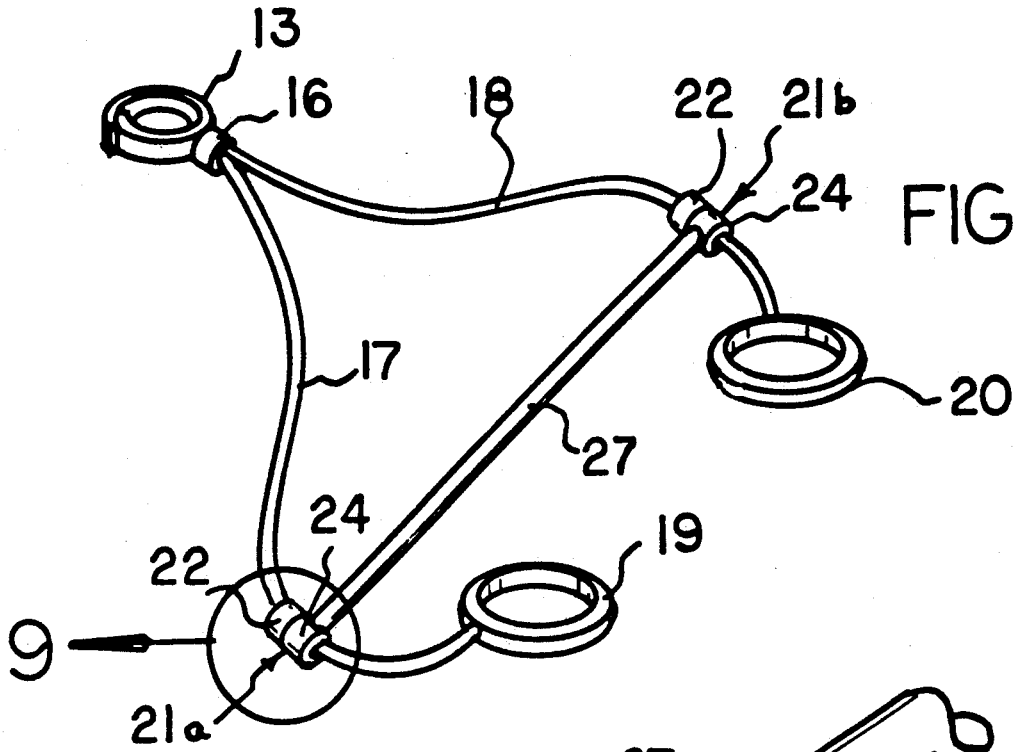
FIG. 8 is an isometric illustration of the invention employing a connecting rod structure between opposed exercise straps.
Figure 9:
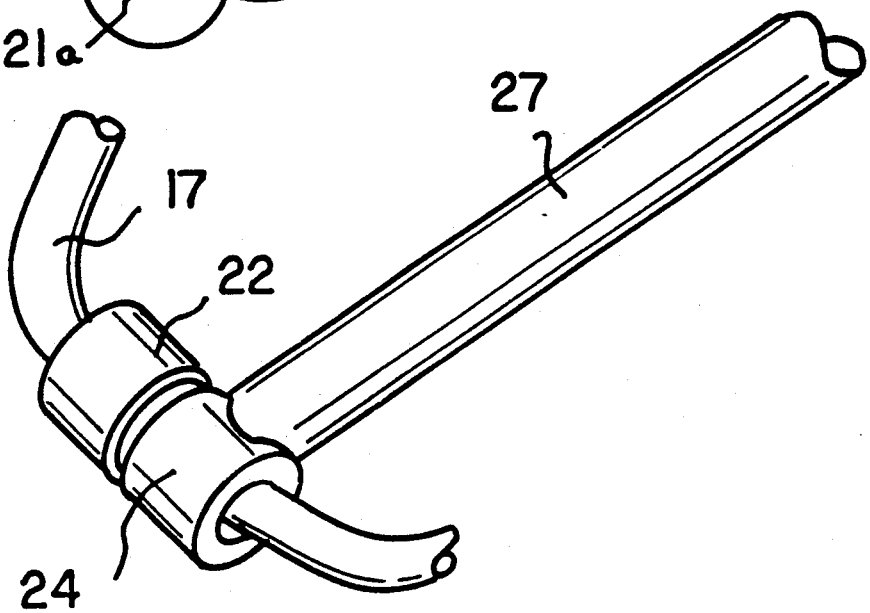
FIG. 9 is an enlarged isometric illustration of section 9 as set forth in FIG. 8.

The FIGS. 8 and 9 illustrate the use of respective first and second slide members 21*a* and 21*b*, each of identical construction of a type as indicated in FIG. 7 for example, with the first slide member 21*a* receiving the first exercise strap 17 therethrough, and the second slide member 21*b* receiving the second exercise strap 18 therethrough. The second tubes 24 of each of the first and second slide members 21*a* and 21*b* fixedly mount a rigid connecting rod 27 fixedly and orthogonally relative to the second tube bores 25 of the second tubes 24. The spacing of the first and second straps by utilization of the rigid connecting rod 27 provides an added degree of difficulty in use of the exercise apparatus affording degrees of exercise training.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A treadmill exercise apparatus for use with a treadmill member, having a treadmill member, having a treadmill support, wherein the apparatus comprises, a mounting collar strap adapted for securement about the treadmill support, with the mounting collar strap having a collar strap first end and a collar strap second end, with the collar strap first end having a first fastener, the collar strap second end having a second fastener, with the first fastener and second fastener arranged for securement relative to one another, and an anchor boss fixedly mounted medially of the strap member, and a first flexible exercise strap and a second flexible exercise strap, each of an equal predetermined length, with the first strap having a first strap first end and a first strap second end, the second strap having a second strap first end and a second strap second end, the first strap first end and the second strap first end are fixedly secured to the anchor boss, the first strap second end includes a first strap ring mounted thereto, the second strap second end includes a second strap ring mounted thereto for manual grasping of the first strap ring and the second strap ring, and a slide member, the slide member including a first tube selectively securable to a second tube, with the first tube and the second tube coaxially aligned, the first tube including a first tube bore, the second tube including a second tube bore, with the first tube bore and the second tube bore in communication relative to one another to receive at least said first strap through the slide member, and the first tube bore formed with a conical internal thread, with the second tube having an externally threaded conical split plug coaxially aligned with the second tube threadedly received within the first tube bore to receive at least said first strap through the slide member to effect selective securement of the first strap within the slide member.

2. An apparatus as set forth in claim 1 including a second slide member, the second slide member including a second slide member first tube and a second slide member second tube, the second slide member first tube having a second slide member first tube bore formed with an internal conical thread, and the second slide member second tube including a second slide member second tube conical externally threaded split plug threadedly received within the second slide member first tube bore, with the second exercise strap slidably and adjustably directed through the second slide member, and a rigid connecting rod fixedly secured to the second tube and to the second slide member second tube.

3. An apparatus as set forth in claim 2 wherein the rigid connecting rod is orthogonally oriented relative to the second tube bore and to the second slide member second tube bore.

* * * * *